US005165319A

United States Patent [19]

Snyder et al.

[11] Patent Number: 5,165,319

[45] Date of Patent: Nov. 24, 1992

[54] CUTTING KNIFE WITH MULTIPLE INSERT BLADES

[75] Inventors: Dennis L. Snyder, Dover Township, York County; Michael C. Smith, Jackson Township, York County, both of Pa.

[73] Assignee: Advance Graphics Equipment of York, Ltd., York, Pa.

[21] Appl. No.: 817,088

[22] Filed: Jan. 6, 1992

[51] Int. Cl.[5] ..... B26D 1/143

[52] U.S. Cl. ..... 83/840; 83/844; 83/665; 83/675; 83/853; 83/854

[58] Field of Search ..... 83/836, 838, 839, 840, 83/842, 853, 854, 934, 676, 675, 665, 677, 673, 663; 407/35, 36, 37, 38

[56] References Cited

U.S. PATENT DOCUMENTS 3,542,528 11/1970 Bech ..... 407/37
3,990,337 11/1976 Barbour, Jr. ..... 83/837
4,480,518 11/1984 Futterer ..... 83/934
4,840,098 6/1989 Gämmerler ..... 83/676

*Primary Examiner*—Frank T. Yost
*Assistant Examiner*—Allan M. Schrock
*Attorney, Agent, or Firm*—Charles J. Long

[57] ABSTRACT

A rotary cutting knife for paper cutting apparatus or the like includes a circular periphery carrier with a planar front face and a peripheral wall. Cylindrical bores in the peripheral wall receive cylindrical blade inserts. Each blade insert includes at its outer end an inclined planar blade face which intersects the cylindrical insert wall to form a cutting edge of elliptical contour. The insert receiving bores in the carrier are so oriented that inserts can be and are mounted therein with their blade faces all lying in a cutting plane parallel to the planar front face of the carrier and perpendicular to the axis of carrier rotation. Additionally, the bore orientation is such that the outer ends of the inserts lag their inner ends in the direction of carrier rotation. The assembly provides improvements in strength, blade wear life and precision of cut.

9 Claims, 2 Drawing Sheets

Fig. 3
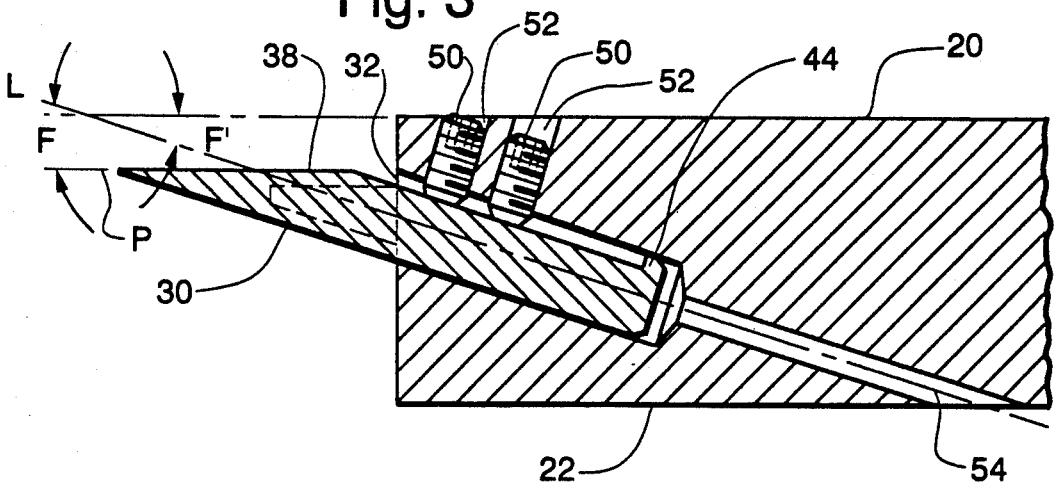
Fig. 4
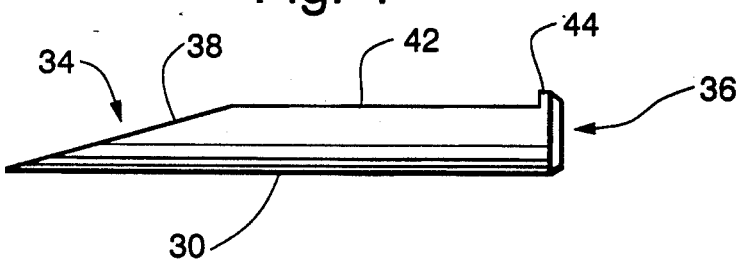
Fig, 5
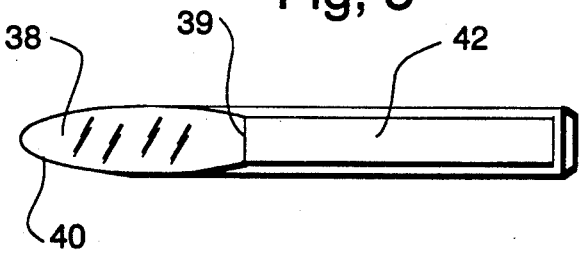
Fig. 6
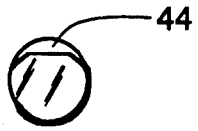

CUTTING KNIFE WITH MULTIPLE INSERT BLADES

BACKGROUND OF THE INVENTION

1. Field of the Invention

This invention relates to rotary cutting knives for cutting apparatus of the type typically used for precision cutting of multi-layer paper products such as collated pages of unbound books. More particularly, the invention relates to such knives in which multiple inserts form the blade portion of the knife and are mounted and shaped in a manner providing performance superior to similar knives of the prior art.

2. Description of the Prior Art

In the field of book making, cutting machines employing rotating cutting knives are commonly used to trim or precision cut multi-layer paper thicknesses, such as collated unbound book pages. Many of such machines employ a rotary cutting knife cutting the product and an opposed so-called "anvil knife" rotating at a surface speed matching the product feed speed and maintaining the product in proper relationship to the blades of the cutting knife to ensure precision and completeness of the cut. In such apparatus the feed stock is generally conveyed through the rotating knife array in a feed plane perpendicular to the cutting plane defined by the blade or blades of the rotary knives; the knives in turn rotate about an axis of rotation which is parallel to the feed plane.

In continuing efforts to improve the performance, life or cost of rotary cutting knives, several prior art workers have developed knives in which the cutting edges comprise series of blade inserts mounted on rotating carrier members. For example, Barbour, Jr. U.S. Pat. No. 3,990,337 discloses a cutting wheel with insertable cutting bits slidingly received in sockets and held in position by clamping blocks. The bits include straight cutting edges facing in the direction of wheel oration at an angle of about 45 degrees from a wheel radius passing through the outer tip of the blade—i.e. in each bit the cutting edge leads the rest of the bit in the direction of rotation. The cutting edges of Barbour's bit are formed by beveling an end of the bit at a predetermined angle of 20–40 degrees, and the sockets are oriented at the same angle with the cutting plane, such that the bit faces all lie in the cutting plane. Another example in the prior art is Gammerler U.S. Pat. No. 4,840,098, which discloses another cutting wheel, this one having a front face defining the cutting plane, a rear face having a truncated cone surface, and a series of rectangular blade inserts mounted on the rear face by means of screws. The blade inserts include straight cutting edges formed by grinding the insert ends at the same angle that the rear face forms with the cutting plane face, and the inserts are positioned so that bevelled faces all lie in the cutting plane defined by the front face of the cutting wheel. As with Barbour, Jr., the Gammerler cutting edges face in the rotation direction—i.e lead the body of the inserts in that direction, but in this case they form an angle of about 80 degrees with a wheel radius passing through the mid-point of the cutting edges.

All such prior art devices of which we are aware are characterized by the following:

A. The cutting edges of the blade inserts are straight;

B. The cutting edge leads the body of the insert in the direction of rotation;

C. The inserts are formed from relatively thin metal strips; and

D. The inserts are secured to a face of the cutting wheel, or in a groove cut in such face, by screws or a combination of screws and clamps.

Several shortcomings result from the design features of prior art rotary cutting knives. First, the positioning and mounting methods heretofore employed direct nearly all of the reactive cutting forces against the clamping screws or members holding the blade inserts in place. Second, the inserts have limited bending resistance because of their thin cross section, thereby making them prone to bending or breaking in use. Third, the use of straight cutting edges terminating at corners can result in unacceptable cuts if the positional adjustment of the knife or its cutting inserts is not carefully maintained to prevent the corners of the insert blades contacting the advancing paper being cut—i.e. if the blade corner strikes the paper it can cause rough cuts which are generally unacceptable in the book manufacturing industry. Finally, again because of the thin cross sections of the blade inserts, wear on the cutting edges tends to be higher than desirable, requiring frequent regrinding of the inserts to maintain sharpness.

SUMMARY OF THE INVENTION

We have found that the disadvantages of prior art rotary cutting knives can be minimized or eliminated by the use of cutting knives in accordance with the invention. In their preferred embodiments our cutting knives are characterized by inserts which are cylindrical in shape with a planar blade face formed at one end to define an elliptical cutting edge, and are received in bores in the body of the blade carrier so that reactive cutting forces are resisted by the carrier itself rather than by mounting screws.

In accordance with the broadest aspects of the invention we provide, for use in a cutting assembly of the type wherein cutting is effected by rotating a rotary cutting knife in a predetermined direction about an axis of rotation, a rotary cutting knife comprising a) a blade carrier; b) a plurality of elongate blade inserts, each having a body surface, a longitudinal axis, and first and second ends, the first end including a planar blade face inclined at an angle of from 12 to 25 degrees with the longitudinal axis and intersecting the body surface, the body surface at the line of intersection with the blade face being curved in such manner as to define a cutting edge forming a segment of an ellipse; and c) means securing the inserts to the blade carrier in such orientation that the following listed conditions are satisfied: i) the first ends of the inserts are radially outward from their second ends; ii) the blade faces all lie in a cutting plane which is perpendicular to the axis of rotation; iii) the cutting edges are equidistant from the axis of rotation and each cutting edge is on the rotationally leading side of its respective blade face; and iv) at the radially outermost point of the first end of each insert, the longitudinal axis of the insert intersects a radius from the axis of rotation at an angle of up to 33 degrees, measured in the cutting plane, with the first end of the insert lagging its second end in the direction of rotation. Preferably, the body surface of each elongate insert is cylindrical about the insert's longitudinal axis. For better results, the blade carrier is of circular periphery and predetermined thickness and is cylindrical about the axis of rotation over a substantial portion of its thickness.

In a preferred embodiment, we provide a rotary cutting knife for use in cutting apparatus wherein the cutting knife is rotated in a predetermined direction about an axis of rotation, comprising: a) a circular periphery blade carrier of predetermined thickness, having a planar front face, a rear face, and a peripheral wall of which at least a major portion is cylindrical about the axis of rotation, the blade carrier including a plurality of cylindrical bores extending inwardly from the peripheral wall at sites spaced equally around the periphery and at a predetermined distance from the front face, each bore having a longitudinal axis and being so oriented that i) an extension of its longitudinal axis beyond the peripheral wall intersects the plane defined by the front face at a first angle of from 12 to 25 degrees, and ii) its peripheral terminus lags its radially inward portion in the direction of rotation at a lag angle of up to 33 degrees, the lag angle being measured in a plane parallel to the front face between an extension of the bore's longitudinal axis at a point spaced a predetermined distance from the peripheral wall and a radius passing through said point from the axis of rotation, said point being on the circumference of a blade circle; b) a plurality of generally cylindrical blade inserts received in the cylindrical bores, each insert having inner and outer ends and a longitudinal axis, the outer end of each insert including a planar blade face inclined to form said above-mentioned first angle with the insert's longitudinal axis, the line of intersection of the blade face with the cylindrical surface of the insert defining a cutting edge which is a segment of an ellipse; and c) means securing the inserts in the cylindrical bores in such positions that their radially outermost tips lie along the blade circle and their blade faces all lie in a cutting plane parallel to the carrier's front face and located between said front face and the peripheral termini of the bores.

Preferably the means securing each insert in its cylindrical bore comprise a threaded hole extending from the front face of the carrier through the wall of the bore, and a clamping screw threaded through the hole and bearing on the surface of the insert.

For better positional stability and safety, each insert further includes a planar surface parallel to the insert's longitudinal axis and truncating the inner end of the planar blade face, said planar surface being oriented such that the line of intersection between it and the planar blade face is perpendicular to the longitudinal axis of the insert, the planar surface extending from said line of intersection to a point near the inner end of the insert, and the clamping screw bears on the planar surface.

For optimum cutting effectiveness the first angle is about 17 degrees and the lag angle is between 23 and 33 degrees, about 28 degrees being especially preferred.

Other details, objects and advantages of the invention will become apparent as the following description of a certain present preferred embodiment thereof proceeds.

BRIEF DESCRIPTION OF THE DRAWINGS

In the accompanying drawings we have shown a certain present preferred embodiment of the invention in which:

FIG. 3 is a detailed sectional view of a blade insert mounting, taken on line 3—3; and FIGS. 4–6 are, respectively, side, top and end views of a preferred blade insert according to the invention.

DESCRIPTION OF THE PREFERRED EMBODIMENT

Figure 2:
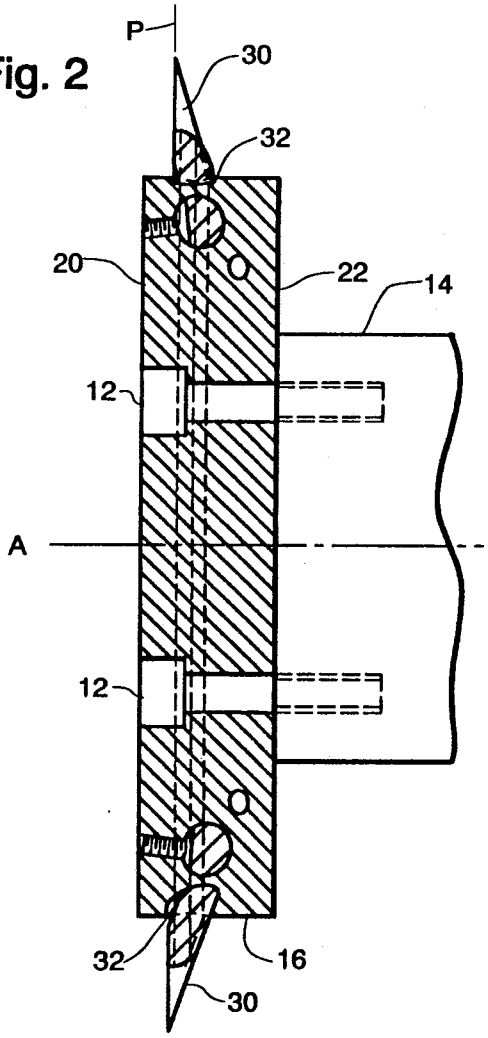
FIG. 2 is a vertical sectional view taken on line 2—2 of FIG. 1.
Figure 1:
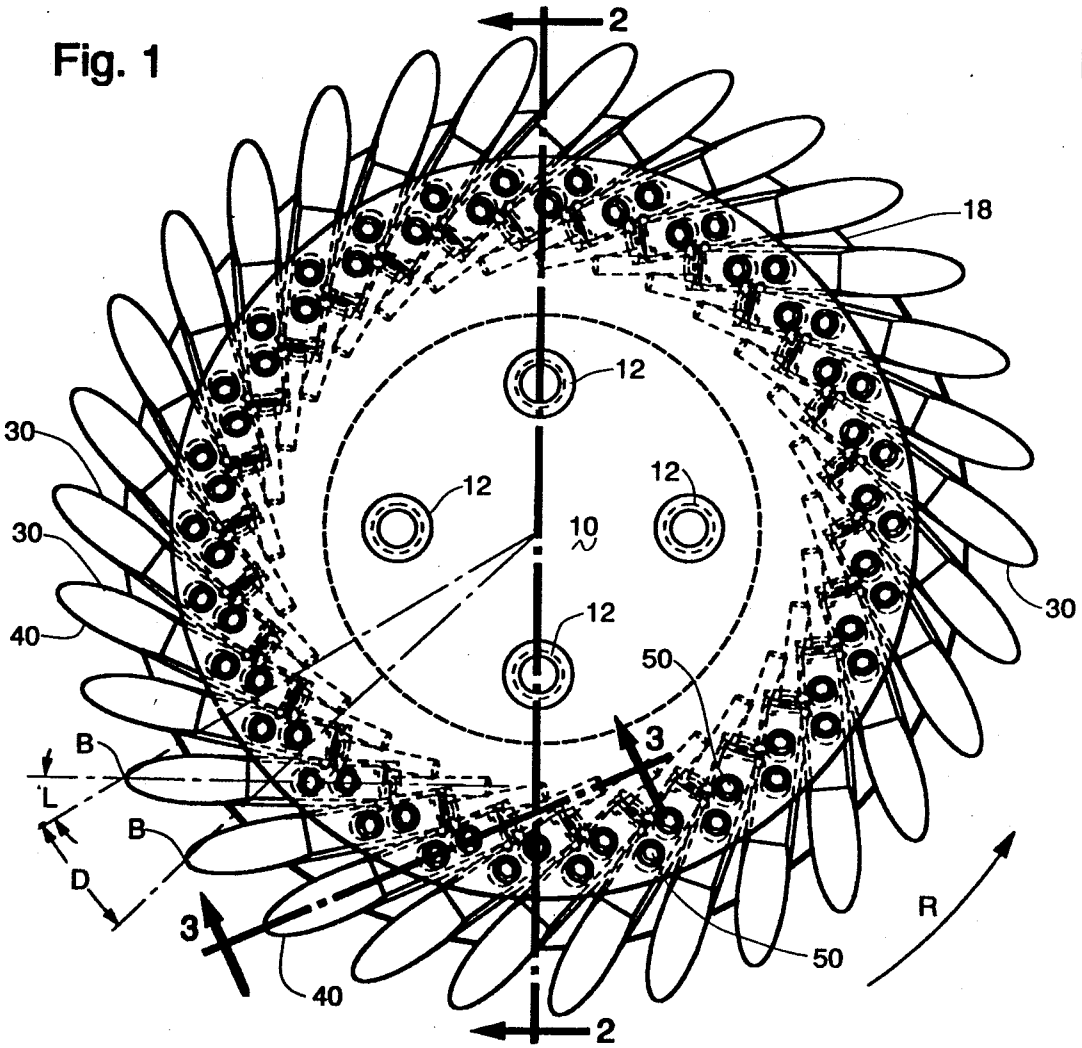
FIG. 1 is an elevational view of the front face of a rotary cutting knife according to the invention.

Referring first to FIGS. 1 and 2, a blade carrier 10, which may be fabricated from alloy steel or the like, is attached by bolts 12 to the drive shaft 14 of an electric motor or other means for rotating carrier 10 about an axis of rotation A in the direction shown by arrow R in FIG. 1. Carrier 10 is of predetermined thickness and circular periphery, and over a substantial portion of its thickness its peripheral wall 16 is cylindrical about axis of rotation A. In the embodiment shown the peripheral wall 16 is interrupted by an optional raised reenforcing rib 18 which provides added support as discussed below. The front face 20 of carrier 10 is planar and perpendicular to axis of rotation A; for simplicity, the back face 22 of the carrier is also shown as planar. Other carrier configurations may be used without departing from the invention.

A plurality of generally cylindrical blade inserts 30 are closely received in cylindrical bores 32 formed in the peripheral wall 16 of carrier 10. The inserts and bores are preferably evenly spaced around the periphery of the carrier, although uneven spacing might be found useful in some unusual applications, as may be apparent to those skilled in the art. The number and spacing of inserts is determined by factors such as the overall size of the cutting knife, the rotational speed at which it is operated, and the type and feed rate of the material being cut, as will be appreciated by those skilled in the art. The embodiment shown has thirty blade inserts evenly spaced around the carrier periphery; accordingly, the angular distance between adjacent inserts, shown as angle D in FIG. 1, is 12 degrees.

We have found that rotary cutting knives according to the invention achieve improved cutting performance principally because of two features; a) the cutting edges of the blade inserts are of elliptical contour; and b) the radially outward ends of the inserts lag the insert bodies in the direction of rotation. Additionally, in preferred embodiments such as that shown in the drawing figures, improvement in service life of the blade inserts and strength of the assembly are achieved through the use of properly shaped inserts and our preferred approach to mounting them in the blade carrier. These features will now be described.

Referring now to FIGS. 3 through 6, an elongate, generally cylindrical blade insert 30 may be fabricated from sintered carbide or other material having the properties necessary to hold an edge for cutting. The insert has a first, outer, or blade end 34 and a second or inner end 36. At its first end the insert 30 is ground or otherwise formed to include an inclined planar blade face 38. The preferred angle of blade face inclination, shown in FIG. 3 as angle F, is 17 degrees from the insert's longitudinal axis L, but angles of from 12 to 25 degrees can also provide satisfactory results. As is evident from FIG. 5, the line of intersection between blade face 38 and the cylindrical body surface of the insert forms a cutting edge 40 of elliptical contour; in the cylindrical insert shown, the line of intersection is elliptical over most of its length, but practice of our invention requires only that the cutting edge itself be eliptical.

A second planar surface 42 parallel to the insert's longitudinal axis truncates the inner end of the planar blade face 38 and is oriented such that the line of intersection 39 between the two planar surfaces is perpendicular to the longitudinal axis of the insert; surface 42 extends from the inner end of the blade face to a point near the second end of the insert, thereby forming a shoulder 44. The function of surface 42 and shoulder 44 are further described hereinbelow.

In accordance with the invention, and as above stated, inserts 30 are mounted in carrier 10 in such position that certain conditions are satisfied. First, their radially outermost tips extend equidistantly from the periphery of carrier 10, i.e. at equal radial distances from the axis of rotation A. In the embodiment shown this radial distance is indicated at points B in FIG. 1 and it defines the circumference of what we call a blade circle. Second, the blade faces 38 of all the inserts lie in a common cutting plane, indicated by P in FIGS. 2 and 3, which is parallel to the carrier's front face 20, or perpendicular to the axis of rotation A; in the preferred embodiment shown, the cutting plane is located behind the front face 20 of the carrier and close to the peripheral termini of the cylindrical bores 32. Third, the first or outer end of each insert lags its second end in the direction of rotation R; the amount of lag is defined in terms of the lag angle, angle L in FIG. 1, which is measured in the cutting plane between the projected longitudinal axis of the insert and a radius from the axis of rotation at the point where the insert axis intersects the blade circle, e.g. at points B in FIG. 1. Because of drawing imprecision, the lag angle shown in FIG. 1 is about 32 degrees, somewhat greater than the 28 degrees we have found to be optimum; however, we have found that lag angles of up to 33 degrees are acceptable. All inserts have the same lag angle.

The cylindrical bores 32 formed in blade carrier 10 are so oriented that blade inserts received therein will meet the angular conditions above set forth. More particularly, the longitudinal axis of each bore, when extended to the plane of the carrier's front face 20, forms a first angle F' (FIG. 3) therewith equal to the angle of inclination F of the insert's blade face 38, thereby enabling positioning of the blade face in the cutting plane parallel to the carrier's front face. In addition, the peripheral terminus of the bore lags its radially inward portion in the direction of rotation R by an angle equal to the insert lag angle L, measured in the cutting plane at the blade circle between the bore's longitudinal axis and a radius drawn from the axis of rotation.

Each blade insert 30 is secured in position within its bore 32 by clamping screws 50 which are received in threaded holes 52 through the wall of bore 32 and bear upon the second planar surface 42 of the insert. Holes 52 are oriented with their axes perpendicular to the longitudinal axis of bore 32 and also perpendicular to the carrier face 20 when viewed from the end of the bore and down its longitudinal axis; accordingly, when screws 50 bear on planar surface 42 they maintain the blade face 38 in a plane parallel to the carrier's front face 20. Although inserts without the second planar surface can be used satisfactorily in the practice of the invention, it will be appreciated that inclusion of surface 42 greatly simplifies achieving uniform angular orientation of the blade faces.

In setting up our rotary cutting knife for use, the axial position of each insert in its respective bore is adjusted so that the insert's outermost tip lies on the blade circle, after which the clamping screws 50 are tightened. In the event the screws are not adequately tightened, or become loose during use, shoulder 44 serves as a safety measure by catching on the tip of one of the clamping screws to prevent the insert from being thrown completely out of the carrier by centrifugal force.

As clearly shown in FIG. 3, a small access bore 54 extends from the bottom of bore 32 through the back face 22 of the carrier. This bore allows use of a rod or the like to push the insert out of its bore in the event the insert becomes jammed therein because of distortion or other factors.

As will be appreciated by those skilled in the art, use of our rotary cutting knife, in common with prior art knives with blade inserts, generates reaction forces from the material being cut. Such forces are exerted in the general direction of the view arrows 3 in FIG. 1. The above described shape, mounting and orientation of the blade inserts in our preferred embodiment of FIGS. 1 and 2 result in the reactive forces being resisted virtually entirely by the body of the carrier, with very little of such forces acting on the clamping screws. This arrangement improves the solidity of the cutting knife assembly and helps to decrease the need for periodic positional readjustment of the blade inserts. In the embodiment shown, the strength and solidity is further improved by a reinforcing rib 18 about the periphery of the blade carrier, which is drilled or otherwise worked to form partial extensions of the insert receiving bores 32.

We have found that the shape and orientation of our blade inserts, in particular the lagging blade ends and elliptical cutting edges, results in cutting being done by a relatively greater distance of cutting edge, which improves wear life of the inserts. In addition, the smooth elliptical contour of the cutting edges produces smoother entry into the feed stock and, when used in combination with an opposing anvil surface, results in shearing action similar to that found in scissors, thereby improving the precision of the cut.

While we have shown and described a certain present preferred embodiment of the invention, it is to be distinctly understood that the invention is not limited thereto, but may be otherwise variously embodied within the scope of the following claims.

We claim:

1. For use in a cutting assembly of the type wherein cutting is effected by rotating a rotary cutting knife in a predetermined direction about an axis of rotation, a rotary cutting knife comprising:

a) a blade carrier;

b) a plurality of elongate blade inserts, each having a body surface, a longitudinal axis, and first and second ends, the first end including a planar blade face inclined at an angle of from 12 to 25 degrees with the longitudinal axis and intersecting the body surface, the body surface at the line of intersection with the blade face being curved in such manner as to define a cutting edge forming a segment of an ellipse; and c) means securing the inserts to the blade carrier in such orientation that the following listed conditions are satisfied:

i) the first ends of the inserts are radially outward from their second ends;

ii) the blade faces all lie in a cutting plane which is perpendicular to the axis of rotation;

iii) the cutting edges are equidistant from the axis of rotation and each cutting edge is on the rotationally leading side of its respective blade face; and iv) at the radially outermost point of the first end of each insert, the longitudinal axis of the insert intersects a radius from the axis of rotation at an angle of up to 33 degrees, measured in the cutting plane, with the first end of the insert lagging its second end in the direction of rotation.

2. A rotary cutting knife as claimed in claim 1 in which the body surface of each elongate insert is cylindrical about the insert's longitudinal axis.

3. A rotary cutting knife as claimed in claim 2 in which the blade carrier is of circular periphery and predetermined thickness and is cylindrical about the axis of rotation over a substantial portion of its thickness.

4. A rotary cutting knife for use in cutting apparatus wherein the cutting knife is rotated in a predetermined direction about an axis of rotation, comprising:

a) a circular periphery blade carrier of predetermined thickness, having a planar front face, a rear face, and a peripheral wall of which at least a major portion is cylindrical about the axis of rotation, the blade carrier including a plurality of cylindrical bores extending inwardly from the peripheral wall at sites spaced equally around the periphery and at a predetermined distance from the front face, each bore having a longitudinal axis and being so oriented that i) an extension of its longitudinal axis beyond the peripheral wall intersects the plane defined by the front face at a first angle of from 12 to 25 degrees, and ii) its peripheral terminus lags its radially inward portion in the direction of rotation at a lag angle of up to 33 degrees, the lag angle being measured in a plane parallel to the front face between an extension of the bore's longitudinal axis at a point spaced a predetermined distance from the peripheral wall and a radius passing through said point from the axis of rotation, said point being on the circumference of a blade circle;

b) a plurality of generally cylindrical blade inserts received in the cylindrical bores, each insert having inner and outer ends and a longitudinal axis, the outer end of each insert including a planar blade face inclined to form said above-mentioned first angle with the insert's longitudinal axis, the line of intersection of the blade face with the cylindrical surface of the insert defining a cutting edge which is a segment of an ellipse; and c) means securing the inserts in the cylindrical bores in such positions that their radially outermost tips lie along the blade circle and their blade faces all lie in a cutting plane parallel to the carrier's front face and located between said front face and the peripheral termini of the bores.

5. A rotary cutting knife as claimed in claim 4 in which the means securing each insert in its cylindrical bore comprise a threaded hole extending from the front face of the carrier through the wall of the bore, and a clamping screw threaded through the hole and bearing on the surface of the insert.

6. A rotary cutting knife as claimed in claim 5 in which each insert further includes a planar surface parallel to the insert's longitudinal axis and truncating the inner end of the planar blade face, said planar surface being oriented such that the line of intersection between it and the planar blade face is perpendicular to the longitudinal axis of the insert, the planar surface extending from said line of intersection to a point near the inner end of the insert, and the clamping screw bears on the planar surface.

7. A rotary cutting knife as claimed in any of claims 4 through 6 in which said lag angle is between 23 and 33 degrees.

8. A rotary cutting knife as claimed in claim 7 in which said first angle is 17 degrees.

9. A rotary cutting knife as claimed in claim 8 in which said lag angle is 28 degrees.

* * * * *